US010583674B2

(12) United States Patent
Fukasawa et al.

(10) Patent No.: US 10,583,674 B2
(45) Date of Patent: Mar. 10, 2020

(54) PRINTING APPARATUS

(71) Applicant: SEIKO EPSON CORPORATION, Tokyo (JP)

(72) Inventors: Koki Fukasawa, Shiojiri (JP); Toru Chino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/942,872

(22) Filed: Apr. 2, 2018

(65) Prior Publication Data

US 2018/0281391 A1 Oct. 4, 2018

(30) Foreign Application Priority Data

Apr. 3, 2017 (JP) ..... 2017-073496

(51) Int. Cl.

| | |
|---|---|
| ***B41J 2/045*** | (2006.01) |
| ***B41J 2/14*** | (2006.01) |
| ***B41J 19/00*** | (2006.01) |
| ***B41J 29/02*** | (2006.01) |
| ***B41J 2/175*** | (2006.01) |
| ***B41J 29/13*** | (2006.01) |

(52) U.S. Cl.

CPC ..... *B41J 19/005* (2013.01); *B41J 2/04548* (2013.01); *B41J 2/04581* (2013.01); *B41J 2/14201* (2013.01); *B41J 2/175* (2013.01); *B41J 29/02* (2013.01); *B41J 29/13* (2013.01); *B41J 2002/14491* (2013.01)

(58) Field of Classification Search

CPC ..... B41J 2/04548; B41J 2/04581; B41J 2/14201; B41J 2/175; B41J 19/005; B41J 29/02; B41J 29/13; B41J 2002/14491

See application file for complete search history.

(56) References Cited

U.S. PATENT DOCUMENTS

| | | | | |
|---|---|---|---|---|
| 5,096,316 A * | 3/1992 | Otsuka | ..... | B41J 29/00 400/139 |
| 2014/0192114 A1 | 7/2014 | Ito et al. | | |
| 2016/0023224 A1* | 1/2016 | Yoshida | ..... | B05B 3/18 239/1 |

FOREIGN PATENT DOCUMENTS

| | | | | |
|---|---|---|---|---|
| JP | 2006-015509 A | 1/2006 | | |
| JP | 2008-235180 A | 10/2008 | | |
| JP | 2009023169 A * | 2/2009 | ..... | B41J 19/005 |
| JP | 2014-133358 A | 7/2014 | | |

* cited by examiner

*Primary Examiner* — Alessandro V Amari
*Assistant Examiner* — Kendrick X Liu
(74) *Attorney, Agent, or Firm* — Workman Nydegger

(57) ABSTRACT

A printing apparatus includes a printing head, a controller, an FFC, and a support section. The printing head discharges liquid onto a medium while moving in a primary scan direction so as to print an image on the medium. The controller controls a discharge state of the liquid from the printing head. The FFC electrically connects the printing head and the controller together so as to enable transmission of control signals, and includes a flat portion. The support section supports the flat portion of the flexible flat cable. A portion of the support section that contacts the flat portion is shorter than a width of the flexible flat cable in an orthogonal direction orthogonal to the primary scan direction.

7 Claims, 12 Drawing Sheets

PRINTING APPARATUS

CROSS-REFERENCE TO RELATED APPLICATIONS

The present application claims priority to Japanese Patent Application No. 2017-073496, filed Apr. 3, 2017, which is hereby incorporated by reference in its entirety.

BACKGROUND

1. Technical Field

Embodiments of the present invention relate to a printing apparatus, such as an ink jet printer.

2. Related Art

A serial type of printing apparatus, in which a printing head that discharges liquid droplets is moved to and fro in a primary scan direction to print an image such as text or graphics on a medium, is known. Such printing apparatuses include a printing head that moves to and fro and a controller that controls the discharge of liquid droplets from the printing head. The controller and the printing head are electrically connected together by a strap shaped flexible flat cable (also referred to as "FFC" hereafter). A curved portion having a curved profile is formed in the FFC intermediate portion of the FFC being doubled back on itself (in a length direction), in a configuration such that the curved portion of the FFC undergoes displacement above a frame having a flat upper face as the printing head moves to and fro (see, for example, JP-A-2014-133358).

However, a flat portion of an FFC, which is contiguous to a curved portion of the FFC and at the opposite side of the curved portion in the length direction to the printing head, is supported by a frame in a state of contact with an upper face of the frame. When, from this state, the printing head moves in the primary scan direction in a direction away from the curved portion of the FFC, the curved portion of the FFC undergoes displacement while the flat portion that was previously in contact with a support section separates from the top of the frame.

Thus, when the curved portion of the FFC undergoes displacement accompanying movement of the printing head, peeling static arises due to the flat portion separating from the top of the frame. Depending on the size of charge from or associated with the peeling static, there is a concern that the peeling static or charge will interfere with the transmission of signals by the FFC from the controller to the printing head.

SUMMARY

Embodiments of the invention relate to a printing apparatus capable of reducing interference from peeling static that is generated or that occurs when a flexible flat cable accompanies movement of a printing head.

A method of addressing the above issues and the advantageous effects thereof will now be described.

A printing apparatus addressing the above issues may include a printing head, a controller, a flexible flat cable, and a support section. The printing head discharges liquid onto a medium while moving in a primary scan direction so as to print an image on the medium. The controller controls a discharge state of the liquid from the printing head. The flexible flat cable electrically connects the printing head and the controller together so as to enable transmission of control signals, and includes a flat portion. The support section supports a flat portion of the flexible flat cable. A portion of the support section that contacts the flat portion is shorter than a width of the flexible flat cable in an orthogonal direction that is orthogonal to the primary scan direction.

In such a configuration, when the flat portion of the flexible flat cable in contact with the support section separates from the support section, the flat portion separates from the support section over a range with a width that is shorter than the total width of the flexible flat cable in the orthogonal direction. The amount of peeling static occurring during separation can accordingly be decreased by an amount commensurate with the comparative shortness of the width of contact in the orthogonal direction in comparison to cases in which there is contact with the support section over a range spanning the total width of the flexible flat cable in the orthogonal direction when the flat portion separates from the support section. Interference from any peeling static occurring at the flexible flat cable accompanying movement of the printing head can accordingly be decreased.

Thus, the support sections are arranged such that the width of portions of the support sections that separate from the flexible flat cable as printing head moves to and fro in the scanning directions are shorter than the width of the flexible flat cable. This reduces the charge associated with peeling static and reduces the likelihood of charge from the peeling static interfering with signals transmitted by the flexible flat cable.

In the printing apparatus, the flexible flat cable may include a curved portion contiguous to the flat portion and formed by the flexible flat cable being bent back at a given position. The curved portion undergoes displacement in the primary scan direction accompanying movement of the printing head. In other words, the curved portion may be displaced and the displacement accompanies movement of the printing head.

Due to the flexible flat cable including the curved portion that undergoes displacement in the primary scan direction accompanying movement of the printing head, this configuration enables the suppression of excessive tension from being placed on the flexible flat cable. This configuration may also suppress or prevent damage from being caused to the flexible flat cable when the printing head moves in the primary scan direction.

In the printing apparatus, the primary scan direction may be taken as an X axis direction, the orthogonal direction as a Y axis direction, and a direction orthogonal to both the X axis direction and the Y axis direction as a Z axis direction. In the printing apparatus, the portion of the support section that contacts the flat portion is provided such that, when viewed along the Z axis direction, a length direction of the contacting portion is a direction intersecting at least one of the X axis direction or the Y axis direction.

This configuration enables the flexible flat cable to be biased in the Y axis direction by a reaction force from the support section when the curved portion of the flexible flat cable undergoes displacement in the X axis direction accompanying movement of the printing head in the primary scan direction. This enables oscillation caused by unstable behavior of the flexible flat cable to be reduced in comparison to cases in which the flexible flat cable is free to move in the Y axis direction when the curved portion undergoes displacement in the X axis direction. Thus, the support section can be configured to suppress displacement in the Y axis direction and may bias the support section in the Y axis direction.

In the printing apparatus, the portion of the support section that contacts the flat portion may be provided such that, when viewed along the X axis direction, a length direction of the portion is a direction intersecting both the Y axis direction and the Z axis direction.

Thus, the support section may have a slant. This configuration enables the flexible flat cable to be biased in the Y axis direction by the slanting of the support section when the curved portion of the flexible flat cable undergoes displacement in the X axis direction accompanying movement of the printing head in the primary scan direction. Thus, oscillation caused by unstable behavior of the flexible flat cable can be reduced in comparison to cases in which the flexible flat cable is free to move in the Y axis direction when the curved portion undergoes displacement in the X axis direction.

In the printing apparatus, the portion of the support section that contacts the flat portion may be, when viewed along the Z axis direction, configured by a plurality of projections provided at a plurality of positions that are spaced apart along both the X axis direction and the Y axis direction. The plurality of projections may be configured such that heights in the Z axis direction of neighboring projections in the Y axis direction become sequentially taller.

This configuration enables the flexible flat cable to be biased in the Y axis direction when the curved portion of the flexible flat cable undergoes displacement in the X axis direction accompanying movement of the printing head in the primary scan direction, by the plurality of projections positioned to be spaced apart along both the X axis direction and the Y axis direction such that heights in the Z axis direction of the projections become sequentially taller on progression along the Y axis direction. This enables oscillation caused by unstable behavior of the flexible flat cable to be reduced in comparison to cases in which the flexible flat cable is free to move in the Y axis direction when the curved portion undergoes displacement in the X axis direction.

In the printing apparatus, when viewed along the Z axis direction, the support section may be provided at a plurality of positions that are spaced apart along the Y axis direction.

This configuration enables oscillation caused by unstable behavior of the flexible flat cable to be reduced due to the flat portion of the flexible flat cable being supported by the plurality of support sections, which are spaced apart along the Y axis direction.

In the printing apparatus, the portion of the support section that contacts the flat portion, when viewed along the Z axis direction, may extend in a direction intersecting the Y axis direction.

This configuration enables the rigidity of a guide member to be raised by the support section that extends in a direction intersecting the Y axis direction in cases configured with the support section provided to a guide member that guides displacement of the curved portion of the flexible flat cable.

In the printing apparatus, when viewed along the Z axis direction, the support section may be provided at a plurality of positions that are spaced apart along the X axis direction.

This configuration enables oscillation caused by unstable behavior of the flexible flat cable to be reduced due to the flat portion of the flexible flat cable being supported in a more stable state by the plurality of support sections that are spaced apart along the X axis direction.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

A description follows regarding embodiments of a printing apparatus, with reference to the drawings.

Figure 1:
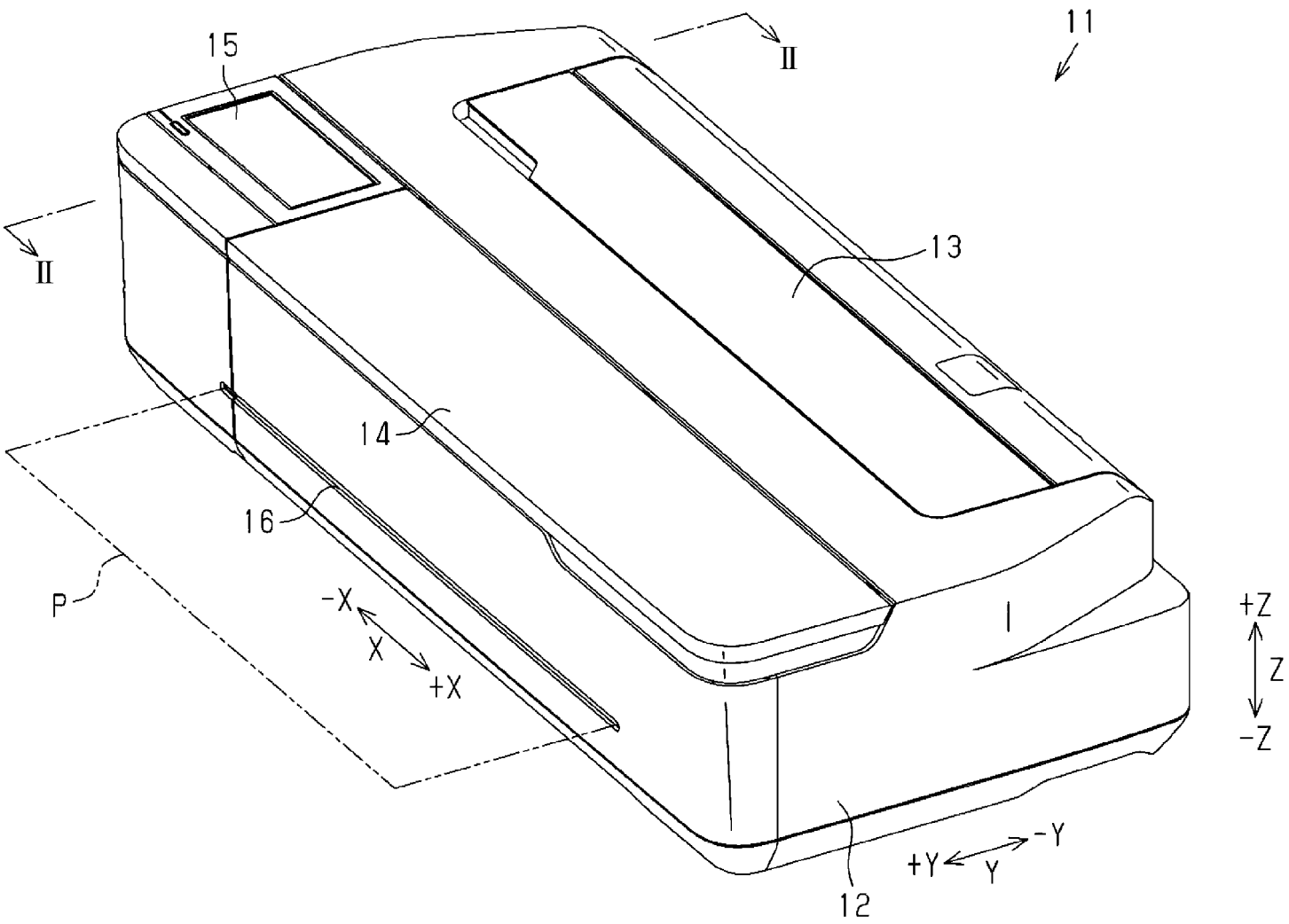
FIG. 1 is a perspective view of an embodiment of a printing apparatus.

In the following description, a printing apparatus 11 illustrated in FIG. 1 is assumed to be placed on a horizontal surface. A direction along the up direction and the down direction (the vertical direction) is illustrated as a Z axis direction, and directions along a horizontal plane are illustrated as an X axis direction and a Y axis direction. Namely, when the printing apparatus 11 is viewed from the front, the X axis direction is the width direction, the Y axis direction is the depth direction, and the Z axis direction is the height direction. Each of these directions being different and mutually orthogonal directions.

As illustrated in FIG. 1, the printing apparatus 11 includes a case 12 of substantially cuboidal shape. A paper feed cover 13 is positioned at a rear side, and a maintenance cover 14 is positioned at the front side. The paper feed cover 13 and the maintenance cover 14 are provided on an upper face of the case 12 so as to be capable of opening and closing. A control panel 15 is provided on the upper face of the case 12 at a position adjacent to the maintenance cover 14 in the X axis direction. The control panel 15 is employed to perform various types of operation of the printing apparatus 11. A discharge port 16 is provided to or at a front face of the case 12, the front face being a side face of the case 12 on the +Y direction side in the Y axis direction. Paper P, serving as an example of a medium printed inside the case 12, is dischargeable toward the front of the printing apparatus through the discharge port 16. In the present embodiment, the +Y direction of the Y axis direction is aligned with the discharge direction of the paper P.

Figure 2:
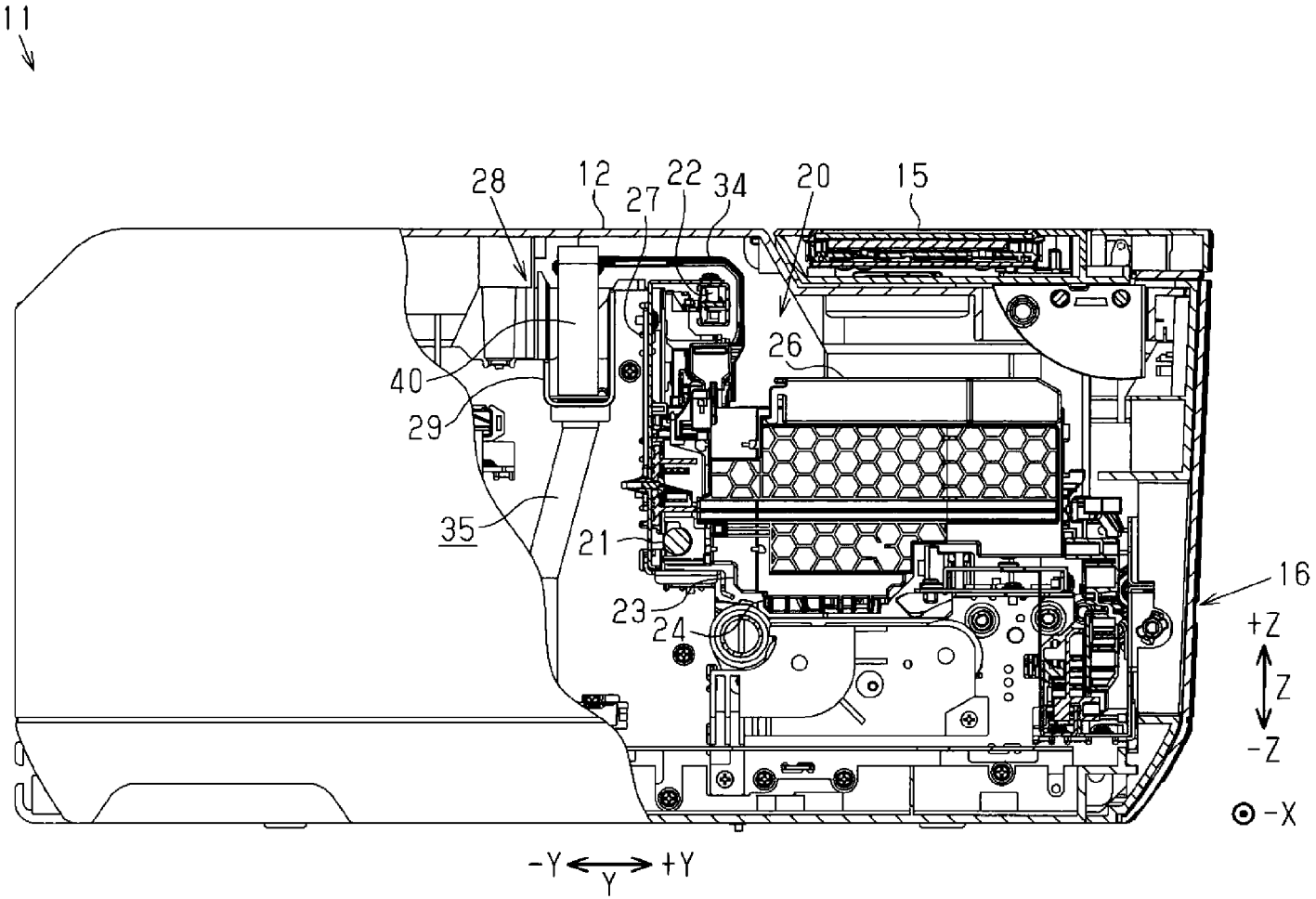
FIG. 2 is a partially cut-away cross-section viewed from arrows II-II in FIG. 1.

As illustrated in FIG. 2, the printing apparatus 11 includes a printing section 20 that prints images such as text or graphics on the paper P inside the case 12. The printing section 20 includes a main guide shaft 21 and an ancillary guide shaft 22 that each extend along the X axis direction inside the case 12. The main guide shaft 21 extends inside the case 12 in the X axis direction at a height position that is approximately at the center in the Z axis direction (height direction) of the printing apparatus 11. The ancillary guide shaft 22 extends inside the case 12 in the X axis direction at a height position that is above the main guide shaft 21. Moreover, the printing section 20 also includes a carriage 23 that is supported by the main guide shaft 21 and the ancillary guide shaft 22 so as to be capable of moving. A printing head 24 is supported by the carriage 23 and moves to and fro in the X axis direction, which is a primary scan direction, together with the carriage 23.

Figure 3:
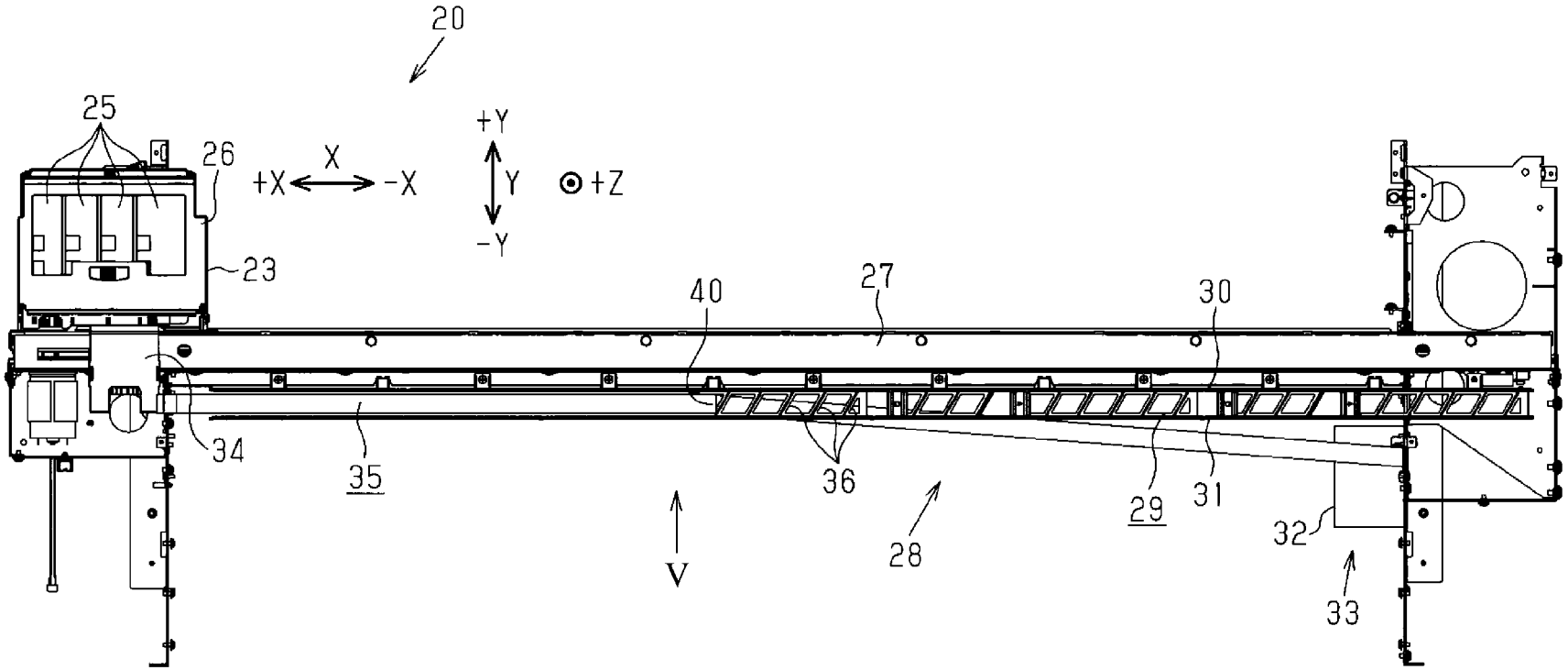
FIG. 3 is a plan view schematically illustrating a printing section.
Figure 4:
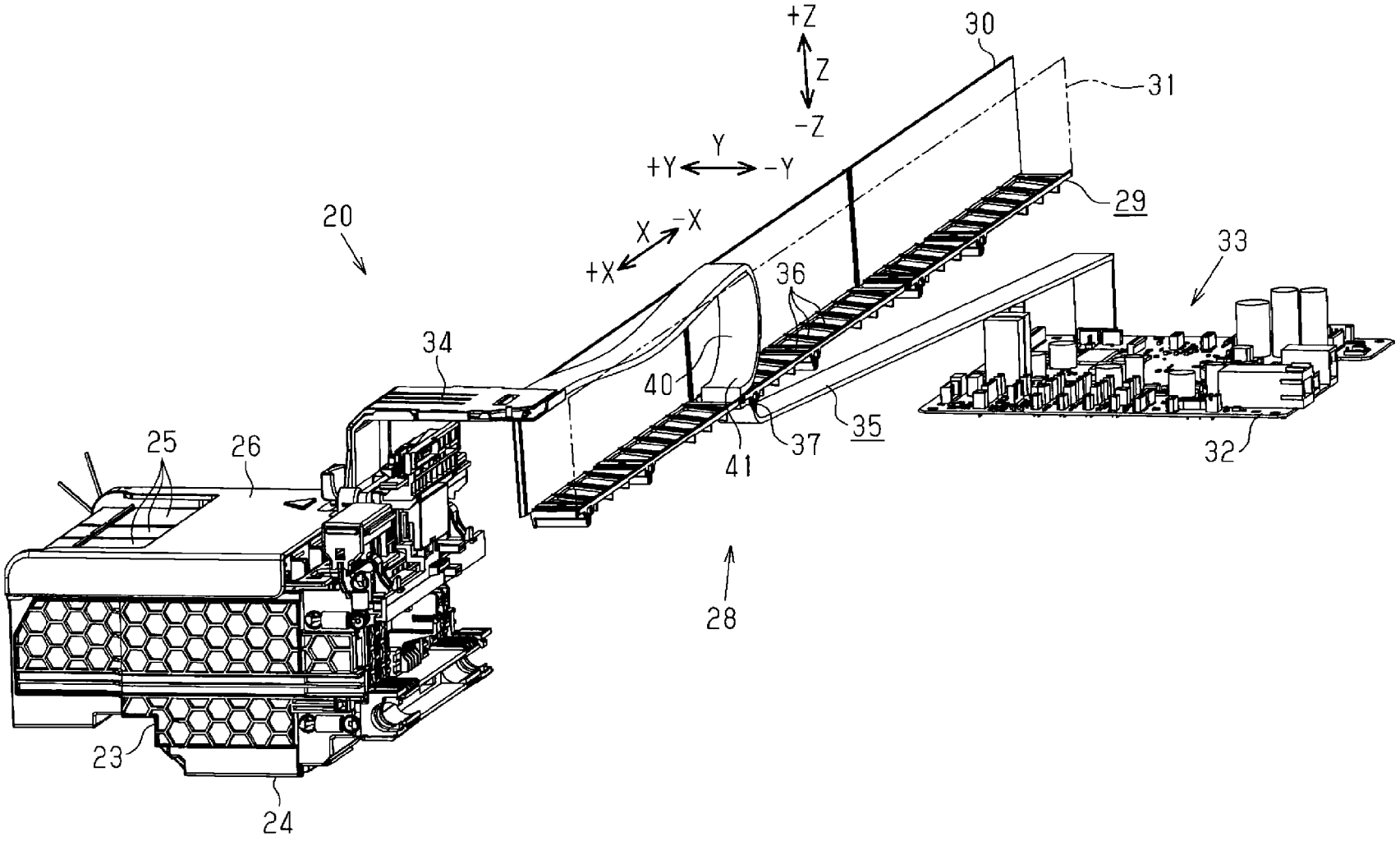
FIG. 4 is a perspective view schematically illustrating a printing section.

As illustrated in FIG. 3 and FIG. 4, in the printing section 20, for example, at least one liquid storage body 25 (four liquid storage bodies 25 in the present embodiment) storing a liquid such as ink are detachably mounted in the carriage 23. Thus, the liquid storage bodies 25 can be removed from the carriage 23 and replaced as needed. While the printing head 24 moves together with the carriage 23 in the X axis direction, which is the primary scan direction, the printing head 24 discharges liquid fed from these liquid storage bodies 25 onto the paper P, so as to print an image on the paper P. Namely, the printing apparatus 11 is what is referred to as a serial type of printing apparatus, in which the printing head 24 is moved to and fro in the primary scan direction to print an image on the paper P. Note that a cover 26 is provided to an upper portion of the carriage 23 such that the liquid storage bodies 25 mounted to the carriage 23 are covered from above. The cover 26 thus covers the liquid storage bodies 25.

As illustrated in FIG. 2 and FIG. 3, the printing section 20 includes a frame 27 that may be a sheet metal structure having a length direction along the X axis direction, which is also the primary scan direction. The frame 27 is provided at a position further to the −Y direction side in the Y axis direction than a movement range of the carriage 23. When viewed along the X axis direction, the frame 27 has a substantially rectangular outline and is elongated in the Z axis direction. The main guide shaft 21 is positioned in a lower portion inside the outline of the hollow profile of the frame 27, and the ancillary guide shaft 22 is positioned in an upper portion inside the outline. A cable support mechanism 28 is provided at a position on the −Y direction side of the frame 27 in the Y axis direction.

The cable support mechanism 28 includes a guide member 29 that extends along the X axis direction and forms a U-shaped profile with an upward facing opening when viewed along the X axis direction. The guide member 29 is formed with a slightly shorter profile than the frame 27. The guide member 29 is supported by the frame 27 with the bottom of the U-shaped profile of the guide member 29 at the bottom, which is the −Z direction in the Z axis direction, and a side wall 30 on the +Y direction side of the guide member 29 opposing a side face on the −Y direction side of the frame 27. To facilitate understanding of the internal structure of the guide member 29, a side wall 31 on the −Y direction side of the guide member 29 is illustrated in FIG. 4 by phantom double-dash broken lines.

As illustrated in FIG. 3 and FIG. 4, a controller 33 configured by an integrated circuit formed on a control substrate 32. The controller 33 may be provided in the cable support mechanism 28 at a position below an end portion on the −X direction side of the guide member 29 in the X axis direction. A connector 34 is provided above the carriage 23. The connector 34 is electrically connected to piezoelectric elements (not illustrated in the drawings). Voltages are applied to the piezoelectric elements to discharge liquid from the printing head 24. The connector 34 and the controller 33 are electrically connected together by a flexible flat cable (also referred to as "FFC" hereafter) 35. The FFC 35 is flexible and has an elongated strap shape.

One length direction end of the FFC 35 (in this case the end on the −X direction side) is connected to the controller 33, and the other length direction end of the FFC 35 (in this case the end on the +X direction side) is connected to the connector 34. Namely, the FFC 35 electrically connects the printing head 24 and the controller 33 together to enable transmission of printing control signals from the controller 33 to the printing head 24 via the connector 34. The controller 33 controls the discharge state of liquid from the printing head 24 by or using the control signals transmitted to the printing head 24 via the FFC 35.

Figure 5:
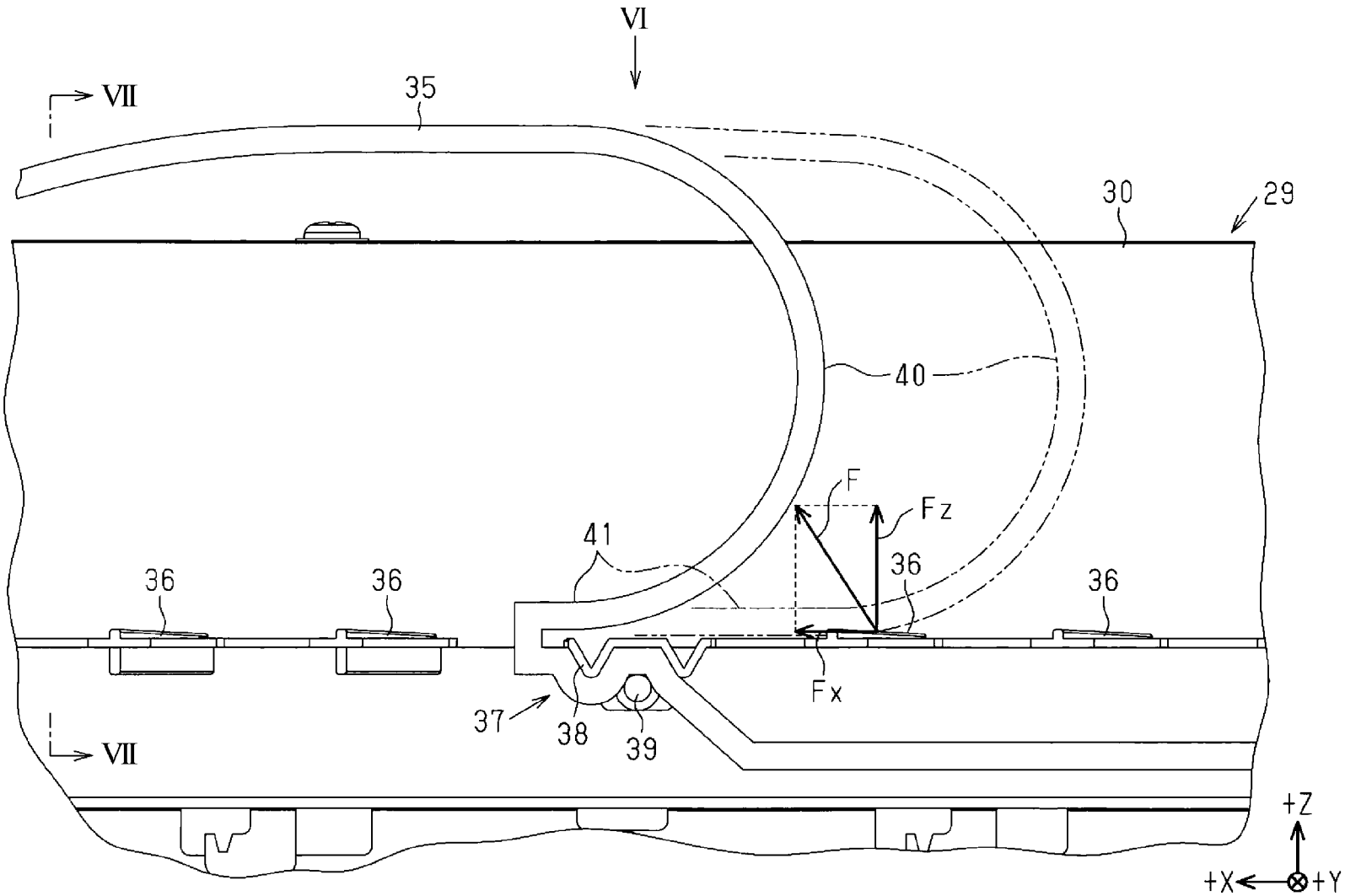
FIG. 5 is a face-on view from arrow V in FIG. 3.

As illustrated in FIG. 4 and FIG. 5, a portion at the +X direction side of a length direction midway point of the FFC 35 is disposed inside (specifically at the upper side of the bottom of) the guide member 29. A portion at the −X direction side of the length direction midway point of the FFC 35 is disposed outside (specifically at the lower side of the bottom of) the guide member 29. Thus, part of the FFC is disposed inside the guide member 29 and part of the FFC 35 is positioned below the guide member 29.

Support sections 36 are formed to or at the bottom of the guide member 29. The support sections 36 are formed from plural ribs disposed at predetermined spacings along the X axis direction. Thus, the support sections 36 are spaced apart from each other in the X axis direction in some embodiments. The support sections 36 may have different configurations and may extend upwardly from a bottom surface of the guide member 29.

A fixing section 37 is formed at a position slightly to the +X direction side of the length direction midway point of the bottom of the guide member 29. The fixing section 37 is capable of fixing the FFC 35 such that the FFC 35 is doubled back. When viewed along the Y axis direction, the fixing section 37 includes an upper clamp 38 having a substantially W-shaped profile (other profiles are possible), and a lower clamp 39 having a circular profile (other profiles are possible). The fixing section 37 is capable of fixing the FFC 35 between the upper clamp 38 and the lower clamp 39 in a zig-zag shaped clamped state at a portion contiguous to the −X side of the doubled-back midway point of the FFC 35. The fixing section 37 securely holds the FFC 35.

The FFC 35 forms or includes a curved portion 40 having a curved profile by inverting a portion of the FFC 35 that is inside the guide member 29 and that is contiguous to the +X direction side of the doubled back portion fixed in the length direction by the fixing section 37. Namely, the flexibly deformable curved portion 40 is formed by inverting a portion of the FFC 35 contiguous to the printing head 24 side from the midway point of the doubling back in the fixing section 37, so as to form a curved profile that bows out toward the −X direction side. Thus, the curved portion 40 is positioned between the connector 34 and the fixing point 37.

When the carriage 23 and the printing head 24 move to and fro in the X axis direction (the primary scan direction), the curved portion 40 undergoes displacement in the X axis direction accompanying such movement. For example, when the printing head 24 moves in the −X direction along the X axis direction, the curved portion 40 undergoes displacement from the position indicated by the solid lines in FIG. 5, in a direction toward the position indicated by the double-dash broken lines. Conversely, when the printing head 24 moves in the +X direction along the X axis direction, the curved portion 40 undergoes displacement from the position indicated by the double-dash broken lines in FIG. 5, in a direction toward the position indicated by the solid lines.

As illustrated in FIG. 4 and FIG. 5, the FFC 35 includes the curved portion 40 formed by bending at a given position, and a flat portion 41 contiguous to or with the curved portion 40 and supported by the support sections 36 from the −Z direction. Specifically, the strap shaped flat portion 41 is formed by a portion of the length direction of the FFC 35 that is contiguous to or with one end of the curved portion 40 (the end at the −X direction side positioned at the lower side in the example of FIG. 5) toward the opposite side of the curved portion 40 to the side where the printing head 24 is positioned.

Configuration is made such that when the curved portion 40 undergoes displacement toward the −X direction side accompanying movement of the printing head 24, the flat portion 41 unrolls from the curved portion 40 so as to extend in length along the X axis direction. Conversely, when the curved portion 40 undergoes displacement toward the +X direction side accompanying movement of the printing head 24, the flat portion 41 unrolled in length along the X axis direction is gradually incorporated into the curved portion 40, and the flat portion 41 thus becomes shorter in length along the X axis direction. The flat portion 41 that changes in length along the X axis direction in this manner accompanying displacement of the curved portion 40 is supported in a stable state at the inside of the guide member 29 by at least one of the support sections 36 contacting the curved portion 40 from the outside (specifically, the opposite side to the side where the curved portion 40 of curved profile is formed, the lower side in the example of FIG. 5). Thus, a length of the flat portion 41 may change as the printing head 24 moves to and fro. The curved portion 40 remains as the printing head moves to and fro in the main scanning directions. However, the position of the curved portion 40 relative to the length of the FFC 35 may change. This is because movement of the printing head changes the position at which the curved portion 40 is located.

Figure 6:
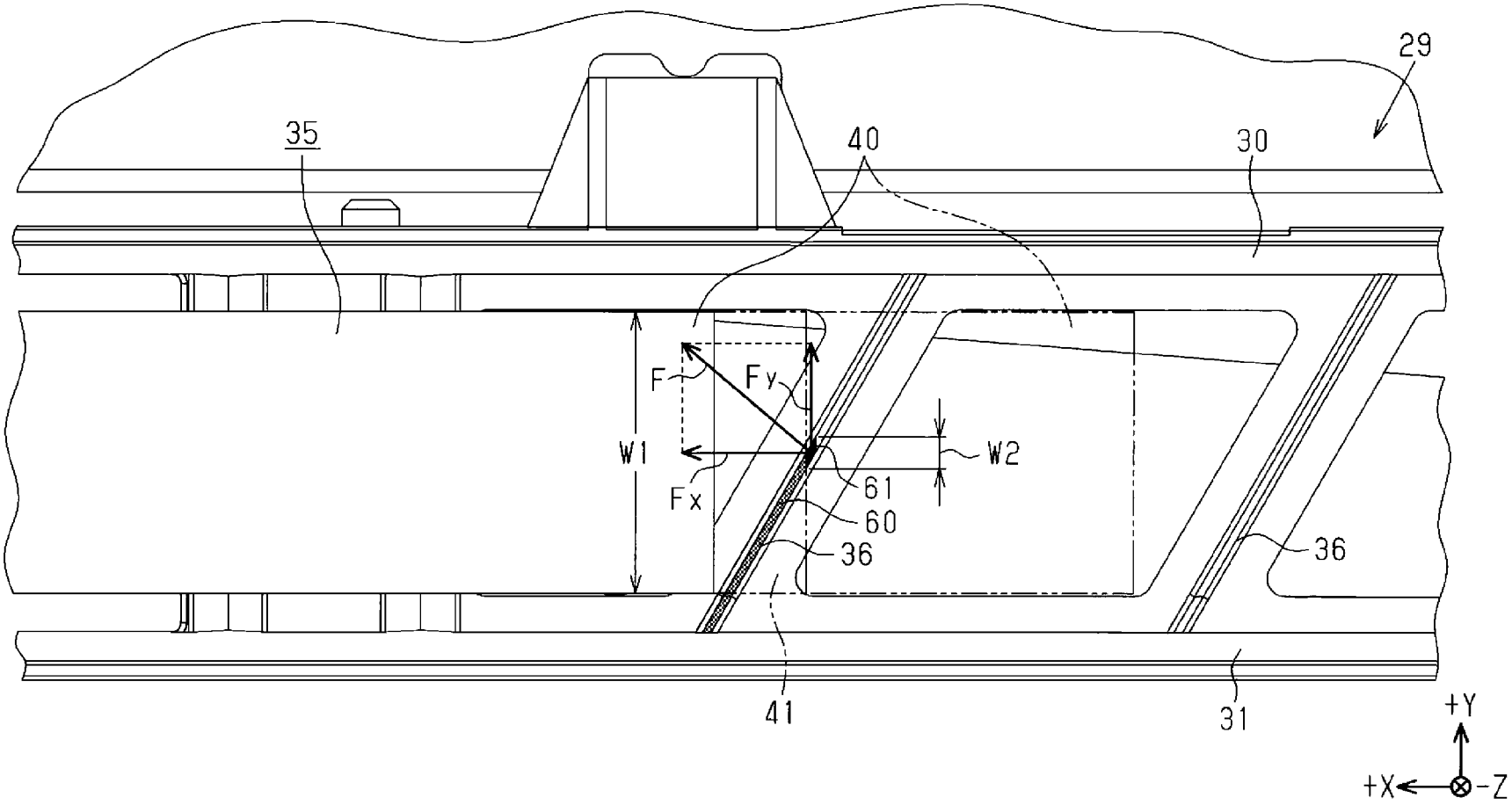
FIG. 6 is a plan view from arrow VI in FIG. 5.

As illustrated in FIG. 6, by way of example, when viewed along the Z axis direction, the rib shaped support sections 36 provided at the bottom of the guide member 29 are provided such that their length directions run in a direction intersecting both the X axis direction and the Y axis direction. Namely, when viewed along the Z axis direction, the portions of the support sections 36 that contact the flat portion 41 from the lower side to support the FFC 35 are provided so as to have a slanted profile in which ends of the support sections 36 on the +Y direction side are skewed toward the −X direction side. Accordingly, as the curved portion 40 undergoes displacement toward the —X direction side, contact regions 60 of the FFC 35 where the flat portion 41 contacts the respective slanted profile support sections 36 gradually extend out in the Y axis direction from the −Y direction side to the +Y direction side. In contrast thereto, as the curved portion 40 undergoes displacement toward the +X direction side, the contact regions 60 of the FFC 35 where the flat portion 41 contacts the respective slanted profile support sections 36 gradually shrink in from the +Y direction side to the −Y direction side.

Moreover, as illustrated in FIG. 6, on the plural rib shaped support sections 36 provided to the bottom of the guide member 29, the portions that contact the flat portion 41 to support the FFC 35 are provided so as to extend in a direction intersecting the Y axis direction (in this case, also the X axis direction), as viewed along the Z axis direction. Moreover, as viewed along the Z axis direction, the plural support sections 36 are provided in plural positions that are spaced apart along the X axis direction.

Figure 7:
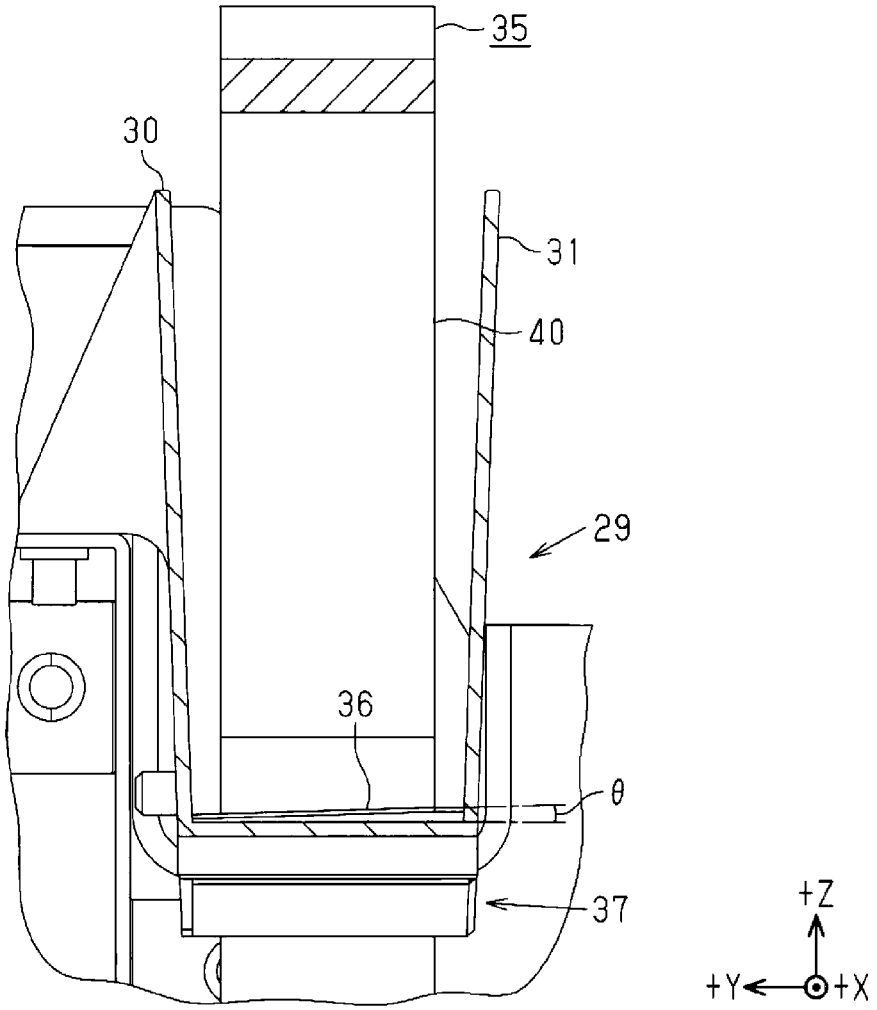
FIG. 7 is a side cross-section viewed from arrows VII-VII in FIG. 5.

Moreover, as illustrated in FIG. 7, the rib shaped support sections 36 provided to or on the bottom of the guide member 29 are provided such that portions that contact the flat portion 41 from the lower side to support the FFC 35 are provided with length directions running in directions intersecting both the Y axis direction and the Z axis direction when viewed along the X axis direction. Namely, the support sections 36 are provided so as to have an inclined profile that, when viewed along the X axis direction, are inclined at a predetermined angle θ such that ends of the support sections 36 on the +Y direction side are lower in the Z axis direction than ends of the support sections 36 on the −Y direction side. Namely, the support sections 36 are provided so as to have an inclined face intersecting with the direction of gravity. Accordingly, when the curved portion 40 undergoes displacement in the X axis direction at the inside of the thus configured guide member 29, the FFC 35 is biased in the +Y direction of the Y axis direction by the support sections 36 that are inclined so as to be lower on the +Y direction side.

Next, a description follows of the operation of the printing apparatus 11 configured in this manner. This description focuses on behavior of the FFC 35 as the curved portion 40 undergoes displacement accompanying movement of the printing head 24.

When an image is being printed on the paper P, control signals are transmitted from the controller 33 to the printing head 24 via the FFC 35. In the serial type printing apparatus 11, the carriage 23 moves to and fro in the X axis direction, which is the primary scan direction, under drive from a carriage motor. The carriage motor is not illustrated in the drawings. An image is printed on the front face of the paper P when this movement occurs by liquid being discharged from the printing head 24 toward the paper P. When this is performed, the curved portion 40 undergoes displacement in the X axis direction accompanying the to and fro movement of the printing head 24. The flat portion 41 is repeated lifted from and placed on the lower surface of the guide member or from the support sections 36 in response to the to and fro movement of the printing head 24.

When the printing head 24 moves in the +X direction of the X axis direction (primary scan direction), the curved portion 40 undergoes displacement from the position indicated by the double-dash broken lines in FIG. 5, in the direction of the position indicated by the solid lines. Accompanying such displacement of the curved portion 40 in the +X direction, the contact regions 60 of the flat portion 41 unrolled in length in the X axis direction, where the flat portion 41 contacts the rib shaped support sections 36 from the +Z direction (from above), separate from the support sections 36 so as to be incorporated into the curved portion 40 as displacement occurs. In other words, the flat portion 41 is lifted from the support sections 36 as the printing head moves in the +X direction. In one example, the flat portion is lifted from or separates from the support sections 36 one support section at a time as the flat portion is incorporated into the curved portion 40.

Each of the rib shaped support sections 36 extends with or has a slanted profile such that the length direction of the support section 36 lies along directions intersecting both the X axis direction and the Y axis direction. As the flat portion 41 of the FFC 35 separates from the top of the respective support sections 36, as illustrated in FIG. 6, a Y axis direction width W2 of a portion contacting the flat portion 41 is shorter than a width W1 of the total width of the FFC 35. In other words, the portion of the support section 36 separating from the FFC 35 has a smaller width W2 because of the manner in which the support sections 26 are arranged. Thus, the FFC 35 separates from a given support section 36 a little at a time according to the movement of the printing head. As the flat portion 41 separates from the support section, this results in a situation where a portion of a given support section 36 is in contact with the FFC 35 while, at the same time, a portion of the same support section 36 is not in contact with the FFC 35. Thus, the width of the support section separating from the FFC, at a given instant, is less than an overall width of the FFC 35 itself.

Namely, the portion of the support section 36 contacting the flat portion 41 is shorter than the width of the FFC 35 in an orthogonal direction (Y axis direction) that is orthogonal to the primary scan direction (X axis direction). The contact regions 60 of the flat portion 41 contacting the support section 36 accordingly separate from each of the support sections 36 over a range 61 having a small peeling surface area corresponding to the width W2. The width W2 is shorter than the width W1 of the total width of the FFC 35.

Figure 8:
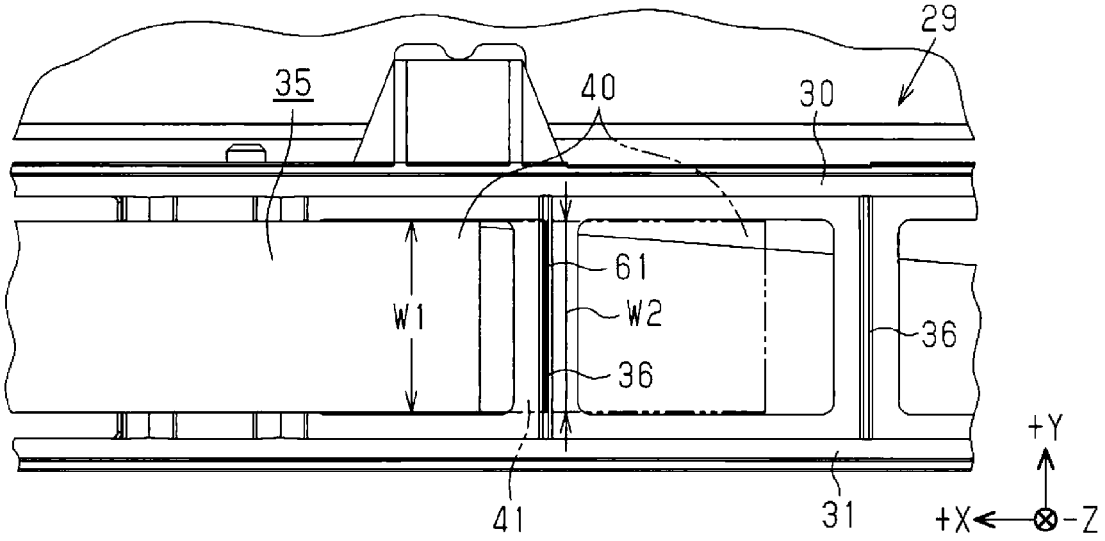
FIG. 8 is an enlarged plan view of a support section of a comparative example.

As illustrated in the comparative example of FIG. 8, the length direction of the rib shaped support sections 36 may extend in a direction parallel to the Y axis direction, i.e. orthogonal to the X axis direction. In this case, as the flat portion 41 of the FFC 35 separates from the top of the respective support sections 36, the Y axis direction width W2 of the portion in contact with the flat portion 41 would be the same as the width W1 of the total width of the FFC 35. Peeling static occurs when the contact regions 60 where the flat portion 41 contacts the support sections 36 separate accompanying displacement of the curved portion 40. Sudden separation from a support section that extends in a direction parallel to the Y axis direction takes place over the respective range 61 having a large peeling surface area corresponding to the width W2 (in FIG. 8) that is the same as the width W1 of the total width of the FFC 35. There is, as a result, a possibility of a large amount of charge from the peeling static, giving rise to concerns regarding the charge interfering with the transmission of control signals by the FFC 35.

In contrast thereto, for the FFC 35 in the present embodiment, as described above, the contact regions 60 of the flat portion 41 contacting the support sections 36 separate from each of the support sections 36 over the range 61, which has a small peeling surface area corresponding to the width W2 as shown, for example, in FIG. 6. This width W2 is shorter than the width W1 of the total width of the FFC 35. The possibility of a large charge amount occurring due to the peeling static is therefore low. As a result, this enables a reduction in concern regarding interference of the associated charge with the transmission of control signals by the FFC 35.

Moreover, when the curved portion 40 undergoes displacement in the X axis direction inside the guide member 29, the curved portion 40 of the FFC 35 deforms flexibly in the Z axis direction. In this case, the curved portion 40 and the flat portion 41 contiguous thereto may behave by oscillating in the Y axis direction. In such cases, for example, were the flat portion 41 free to move in the Y axis direction, there would be a concern that such oscillation might interfere with the transmission of control signals by the FFC 35. To address this point, in the present embodiment, the rib shaped support sections 36 are formed with a slanted profile as described above and movement in the Y axis direction is suppressed or prevented. As a result, this type of interference is reduced.

Namely, as illustrated in FIG. 5, a reaction force F acting on the FFC 35 in a direction diagonally upward from the respective support sections 36 is borne by the flat portion 41 as it repeatedly contacts or separates from the support sections 36 accompanying displacement of the curved portion 40. Namely, the flat portion 41 has a positional relationship contacting the respective support sections 36 from both the +X direction side and the +Z direction side. The reaction force F, when this occurs, is a compound force of a reaction force Fx toward the +X direction side and a reaction force Fz toward the +Z direction side. In FIG. 5, an arrow indicates the direction of the reaction force F. The reaction force F is a compound force of the reaction force Fx and the reaction force Fz. The reaction force F acts as a push-back force on the flat portion 41 of the FFC 35 when this occurs.

As illustrated in FIG. 6, the rib shaped support sections 36 in the present embodiment each have a length direction that extends in a direction intersecting both the X axis direction and the Y axis direction. Thus, the flat portion 41 bears the reaction force F acting in a direction orthogonal to the length direction of the support section 36. The reaction force F illustrated in FIG. 6 is the same as the reaction force F illustrated in FIG. 5, and, when viewed along the Z axis direction, is the compound force of the reaction force Fx toward the +X direction side and a reaction force Fy toward the +Y direction side. As a result, the FFC 35 inside the guide member 29 is biased toward one side in the Y axis direction (the +Y direction side in this case), and the behavior is made more stable than cases in which the FFC 35 is free to move in the Y axis direction. In other words, the oscillation may be prevented and the impact of the oscillation on the transmission of signals may be suppressed.

Moreover, in the present embodiment as illustrated in FIG. 7, as viewed along the X axis direction, the portion of the respective support sections 36 that contacts the flat portion 41 of the FFC 35 from the lower side slopes downward at an inclination of the predetermined angle θ such that the end on the +Y direction side of the support section 36 is lower in the Z axis direction than the end on the −Y direction side of the support section 36. Thus, the effect on the FFC 35 of contact with the flat portion 41 from the lower side by the downwardly sloping support section 36, which is lower on the +Y direction side, combines with the effect of gravity on the FFC 35, so as to further bias the FFC 35 inside the guide member 29 in the +Y direction of the Y axis direction. The behavior of FFC 35 is accordingly further stabilized in the Y axis direction when the curved portion 40 undergoes displacement in the X axis direction.

The flat portion 41 of the FFC 35 is supported by the support sections 36 in the configuration in the present embodiment in which the bottom of the guide member 29 is arranged so as to be substantially parallel to the X-Y plane. The side walls 30, 31 of the guide member 29 are arranged so as to be substantially parallel to the X-Z plane. The arrangement of the guide member 29 is, however, not limited thereto. For example, a configuration may be arranged in which the guide member 29 containing the FFC 35 is rotated by 90 degrees from the state in the present embodiment about a rotation axis along the X axis. Namely, a configuration may be adopted in which the flat portion 41 of the FFC 35 is supported by the support sections 36 with the bottom of the guide member 29 substantially parallel to the X-Z plane, and the side walls 30, 31 of the guide member 29 substantially parallel to the X-Y plane. Such a configuration is preferably inclined at a predetermined angle θ such that, as viewed along the X axis direction, the end on the +Z direction side is positioned further to the −Y direction side than the end on the −Z direction side. Doing so means that the FFC 35 is biased toward the direction gravity acts in (the −Z direction side) when the curved portion 40 of the FFC 35 abuts the support sections 36, thereby further stabilizing the behavior in the Z axis direction.

The embodiment described above enables advantageous effects such as the following to be obtained.

(1) In the FFC 35, when the flat portion 41 contacting the support sections 36 separates from the respective support sections 36 as the curved portion 40 undergoes displacement accompanying movement of the printing head 24, the flat portion 41 separates from each of the support sections 36 over the range 61 having a width smaller than the total width of the FFC 35 in the Y axis direction. The amount of peeling static occurring during separation can accordingly be decreased by an amount commensurate with the comparative shortness of the width W2 of contact in the Y axis direction in comparison to cases in which there is contact with each of the support sections over a range 61 having a large peeling surface area spanning the total width of the FFC 35 in the Y axis direction when the flat portion 41 separates from the support sections 36. Interference from any peeling static occurring at the FFC 35 accompanying movement of the printing head 24 can accordingly be decreased.

(2) When the curved portion 40 of the FFC 35 undergoes displacement in the X axis direction accompanying movement of the printing head 24 in the X axis direction (primary scan direction), the FFC 35 can be biased to one side in the Y axis direction (for example, the +Y direction side) by employing the reaction force F from the support sections 36. Oscillation caused by unstable behavior of the FFC 35 can accordingly be reduced in comparison to cases in which the FFC 35 is free to move in the Y axis direction when the curved portion 40 undergoes displacement in the X axis direction.

(3) When the curved portion 40 of the FFC 35 undergoes displacement in the X axis direction accompanying movement of the printing head 24 in the X axis direction (the primary scan direction), the FFC 35 can be biased to one side (for example, the +Y direction side) in the Y axis direction when the support section 36 is inclined with a downward slope. Oscillation caused by unstable behavior of the FFC 35 can accordingly be reduced in comparison to cases in which the FFC 35 is free to move in the Y axis direction when the curved portion 40 undergoes displacement in the X axis direction.

(4) In some cases, the apparatus is configured with the support sections 36 provided to or on the guide member 29. The guide member 29 guides displacement of the curved portion 40 of the FFC 35. In this case, the rigidity of the guide member 29 can be raised by the support sections 36 that extend in a direction intersecting the Y axis direction.

(5) Due to the flat portion 41 of the FFC 35 being supported in a stable state by the plural support sections 36 provided at plural positions that are spaced apart along the X axis direction, oscillation caused by unstable behavior of the FFC 35 can be reduced.

Note that the embodiment described above may be modified in the following manner.

Figure 9:
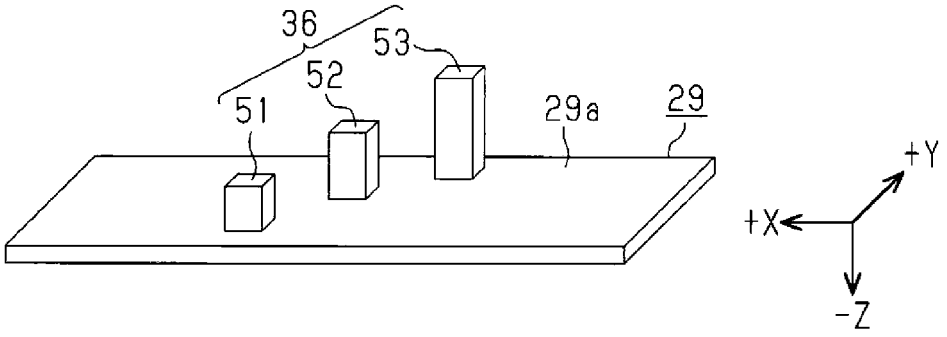
FIG. 9 is a perspective view schematically illustrating a support section of a Modified Example 1.

As illustrated in FIG. 9, a portion of the support section 36 that contacts the flat portion 41 to support the FFC 35 may be configured by or include plural projections 51, 52, 53. The projections 51, 52 and 53 may be provided at plural positions on a bottom wall 29*a* of the guide member 29. The plural projections 51, 52, 53 may be spaced apart along both the X axis direction and/or the Y axis direction, as viewed along the Z axis direction. The plural projections 51, 52, 53 may be provided such that the Z axis direction heights thereof become sequentially taller for the neighboring projections 51, 52, 53 along the Y axis direction. In a Modified Example 1 illustrated in FIG. 9, the projections 51, 52, 53 are provided such that the Z axis direction heights thereof become sequentially taller on progression along the Y axis direction from the projection 51, which is positioned furthest to the −Y direction side, to the projection 53, which is positioned furthest to the +Y direction side. Note that in FIG. 9, the side walls 30, 31 of the guide member 29 and the FFC 35 are omitted from illustration.

Also when configured in this manner, when the flat portion 41 contacting the support section 36 (in this case, the leading end faces of each of the projections 51, 52, 53) separates from the support section 36 as the curved portion 40 undergoes displacement accompanying movement of the printing head 24, the flat portion 41 separates from the support section 36 over a range 61 having a width W2 smaller than the width W1 of the total width of the FFC 35 in the Y axis direction. Thus similar advantageous effects to those described at (1) above can be obtained.

Moreover, in the Modified Example 1, in addition to the advantageous effects described at (1) above, the following advantageous effects can also be obtained. Namely, when the curved portion 40 of the FFC 35 undergoes displacement in the X axis direction accompanying movement of the printing head 24 in the primary scan direction, the FFC 35 can be biased in the Y axis direction by the plural projections 51, 52, 53, which are positioned to be spaced apart along both the X axis direction and the Y axis direction such that their heights in the Z axis direction become sequentially taller on progression along the Y axis direction. Thus, oscillation caused by unstable behavior of the FFC 35 can be reduced in comparison to cases in which the FFC 35 is free to move in the Y axis direction when the curved portion 40 undergoes displacement in the X axis direction.

Figure 10:
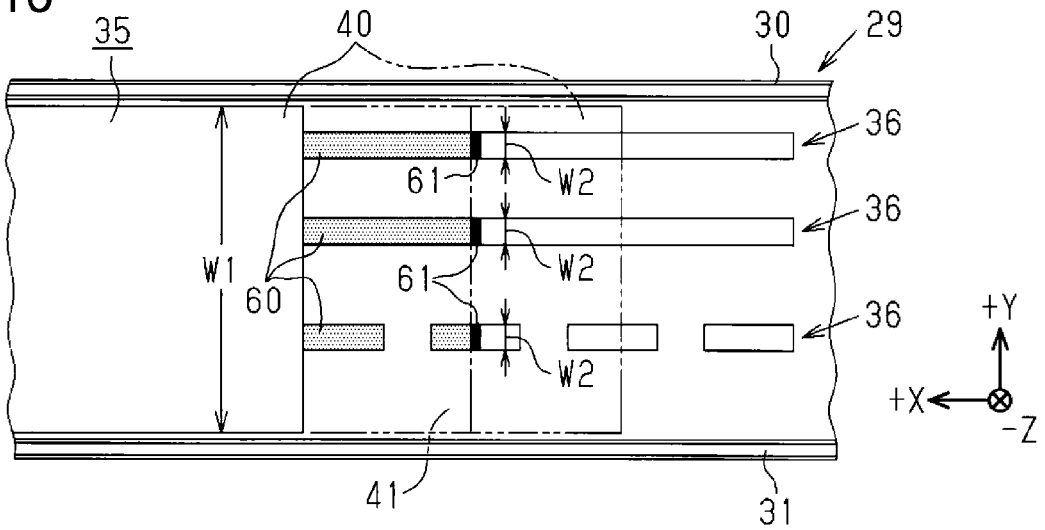
FIG. 10 is an enlarged plan view of a support section of a Modified Example 2.

As illustrated in FIG. 10, the support sections 36 may be configured by providing the support sections 36 at plural positions that are spaced apart along the Y axis direction, as viewed along the Z axis direction. A Modified Example 2 illustrated in FIG. 10 is configured with a support section 36 configured by at least one row (two rows in this example) of elongated projections extending along the X axis direction, and a support section 36 configured by at least one row (one row in this example) of projection groups formed from plural projections arrayed at predetermined spacings. Thus, the plural projections of this row or rows are spaced apart along the X axis direction.

When configured in this manner, when the flat portion 41 contacting the support sections 36 separates from the support sections 36 as the curved portion 40 undergoes displacement accompanying movement of the printing head 24, the flat portion 41 separates from each of the support sections 36 over a range 61 of width W2 smaller than a width W1 of the total width of the FFC 35 in the Y axis direction. Even though there are multiple rows, the overall width W2 of all rows is smaller than the width of the FFC 35. Thus, similar advantageous effects to those described at (1) above can be obtained.

Moreover, in Modified Example 2, in addition to the advantageous effects described at (1) above, the following advantageous effects can also be obtained. Namely, oscillation caused by unstable behavior of the FFC 35 can be reduced due to the flat portion 41 of the FFC 35 being supported by the plural support sections 36 disposed spaced apart along the Y axis direction. Moreover, in Modified Example 2 illustrated in FIG. 10, at least one of the support sections 36 extends continuously along the X axis direction that is orthogonal to (intersects with) the Y axis direction, and so similar advantageous effects to those described at (4) above can be obtained.

Figure 11:
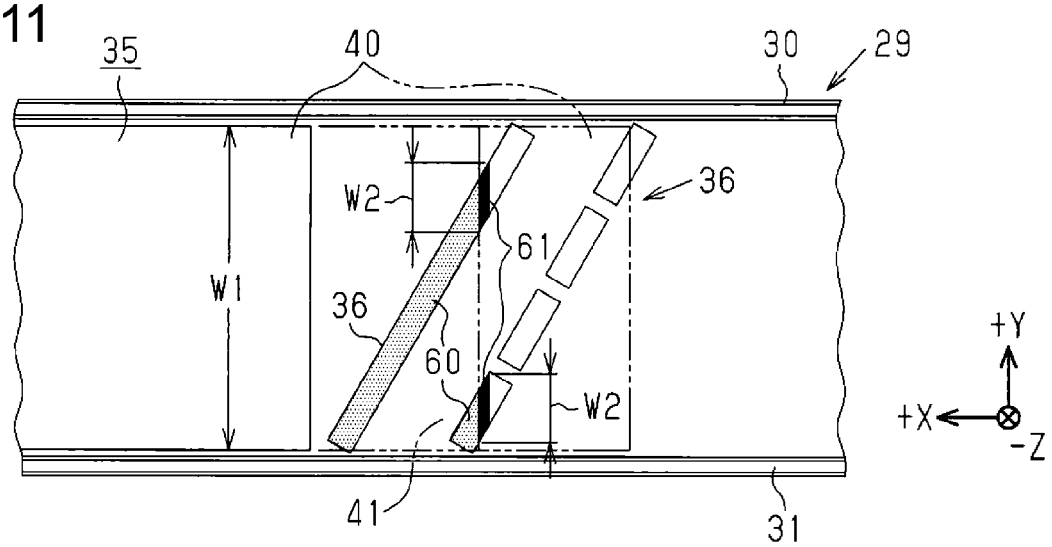
FIG. 11 is an enlarged plan view of a support section of a Modified Example 3.

As illustrated in FIG. 11, the support sections 36 may be a combination of a support section 36 having a length direction that, when viewed along the Z axis direction, extends continuously in a direction intersecting both the X axis direction and the Y axis direction, and a support section 36 configured by a projection group formed from plural projections in a row at predetermined spacings. The plural projections may be spaced apart along a direction parallel to the aforementioned support section 36.

In such a configuration, when the flat portion 41 contacting the support sections 36 separates from the support sections 36 as the curved portion 40 undergoes displacement accompanying movement of the printing head 24, the flat portion 41 separates from each of the support sections 36 over a range 61 of width W2 smaller than a width W1 of the total width of the FFC 35 in the Y axis direction. Thus, similar advantageous effects to those described at (1) above can be obtained.

Moreover, in Modified Example 3 illustrated in FIG. 11, in addition to the advantageous effects described at (1) above, the following advantageous effects can also be obtained. Namely, in Modified Example 3, as viewed along the Z axis direction, the plural support sections 36 having length directions that intersect both the X axis direction and the Y axis direction are provided at plural positions that are spaced apart along the X axis direction. Thus, similar advantageous effects to those of (2) and (4) described above can be obtained.

Figure 12:
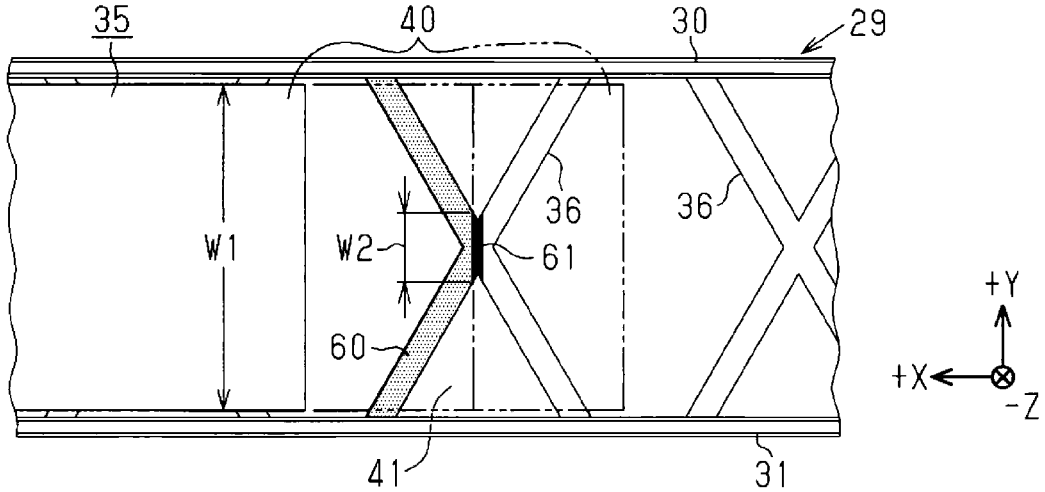
FIG. 12 is an enlarged plan view of a support section of a Modified Example 4.

As illustrated in FIG. 12, the support sections 36 may each be formed, as viewed along the Z axis direction, in an X-shaped cross configured by a first slanted profile rib having a length direction that extends in one direction intersecting both the X axis direction and the Y axis direction, and another or second slanted profile rib having a length direction that extends in a different direction at a position so as to have line symmetry to the aforementioned rib.

Again, in Modified Example 4 illustrated in FIG. 12, when the flat portion 41 contacting the support sections 36 separates from the support sections 36 as the curved portion 40 undergoes displacement accompanying movement of the printing head 24, the flat portion 41 separates from each of the support sections 36 over a range 61 of width W2 smaller than a width W1 of the total width of the FFC 35 in the Y axis direction. Thus, similar advantageous effects to those described at (1) above can be obtained.

Figure 13:
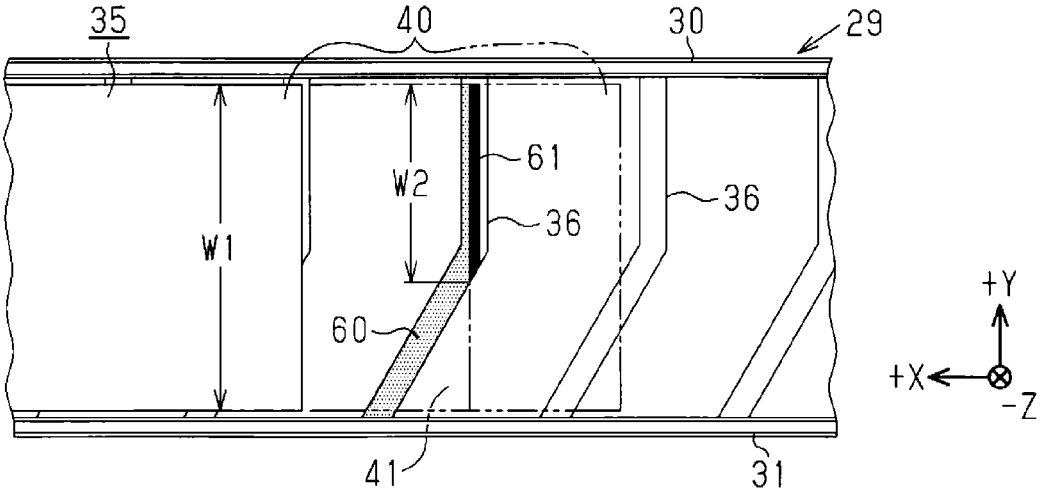
FIG. 13 is an enlarged plan view of a support section of a Modified Example 5.

As illustrated in FIG. 13, the support sections 36 may be configured such that, when viewed along the Z axis direction, half of each of the support sections 36 on one side (the +Y direction side in this example) from a midway point along the length of each of the support sections 36 in the Y axis direction is orthogonal to the X axis direction, and half on the other side (the −Y direction side in this example) from the midway point along each of the support sections 36 extends in a direction intersecting both the X axis direction and the Y axis direction. In other words, the support sections 36 may be configured with a length direction that, when viewed along the Z axis direction, intersects with at least one of the X axis direction or the Y axis direction.

Again, in Modified Example 5 illustrated in FIG. 13, when the flat portion 41 contacting the support sections 36 separates from the support sections 36 as the curved portion 40 undergoes displacement accompanying movement of the printing head 24, the flat portion 41 separates from each of the support sections 36 over a range 61 of width W2 smaller than a width W1 of the total width of the FFC 35 in the Y axis direction. Thus, similar advantageous effects to those described at (1) above can be obtained.

Figure 14:
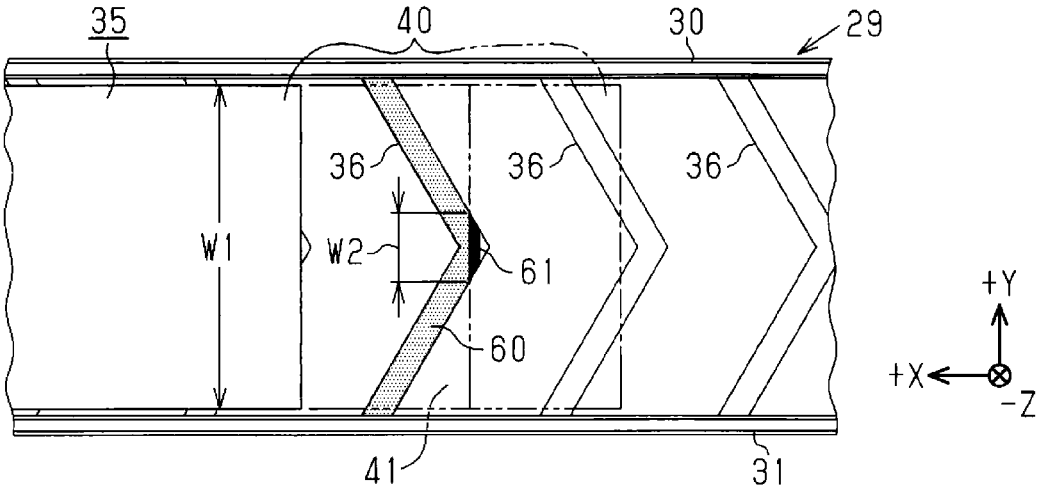
FIG. 14 is an enlarged plan view of a support section of a Modified Example 6.

As illustrated in FIG. 14, the support sections 36 may be configured such that, when viewed along the Z axis direction, half of each of the support sections 36 on one side (the +Y direction side in this example) from a midway point along the length of each of the support sections 36 in the Y axis direction has a length direction extending at an angle in one direction intersecting both the X axis direction and the Y axis direction, and half of the support section 36 on the other side (the −Y direction side in this example) from the midway point along each of the support sections 36 has a length direction extending at an angle in a different direction that is a reverse direction to the aforementioned direction.

Again, in Modified Example 6 illustrated in FIG. 14, when the flat portion 41 contacting the support sections 36 separates from the support sections 36 as the curved portion 40 undergoes displacement accompanying movement of the printing head 24, the flat portion 41 separates from each of the support sections 36 over a range 61 of width W2 smaller than a width W1 of the total width of the FFC 35 in the Y axis direction. Thus, similar advantageous effects to those described at (1) above can be obtained.

Figure 15:
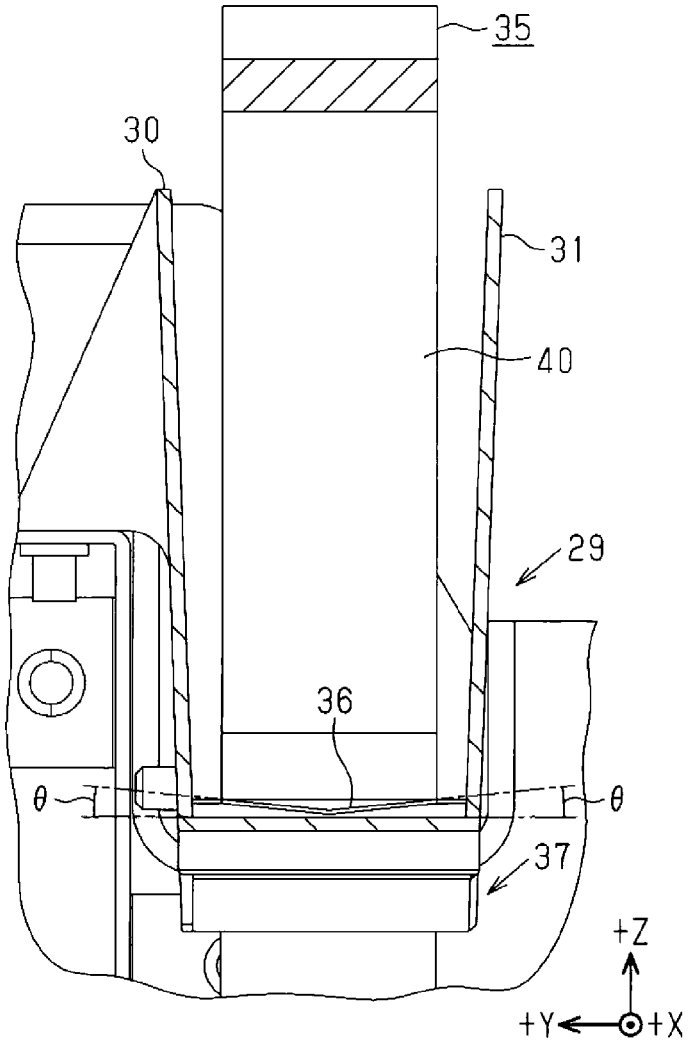
FIG. 15 is a side cross-section of a support section of a Modified Example 7.

As illustrated in FIG. 15, the support sections 36 may, as viewed along the X axis direction, be configured at an inclination angle θ at half of each of the support sections 36 on one side (the +Y direction side in this example) from a midway point along the length of each of the support sections 36 in the Y axis direction, and at the inclination angle θ in the opposite direction at half on the other side (the −Y direction side in this example) from the midway point along each of the support sections 36. Namely, at the bottom of the guide member 29, the support sections 36 may be configured so as to be downwardly inclined on progression from the two sides in the Y axis direction towards the center such that the center of each of the support sections 36 is the lowest point in the Z axis direction. In other words, the support sections 36 may be configured to slope downwards from the walls 30 and 31 of the guide member 29 to a center of a lower surface of the guide portion relative to the walls 30 and 31.

Again, in Modified Example 7 illustrated in FIG. 15, as viewed along the Z axis direction, by setting the length direction of each of the support sections 36 to extend in a direction intersecting the Y axis direction, similar advantageous effects to those described at (1) above can be obtained. Moreover, in Modified Example 7, when the curved portion 40 of the FFC 35 undergoes displacement in the X axis direction accompanying movement of the printing head 24 in the X axis direction (the primary scan direction), the FFC 35 can be biased toward the center in the Y axis direction by the support sections 36 that are downwardly inclined toward the center. Thus, similar advantageous effects to those described at (3) above can also be obtained.

Figure 16:
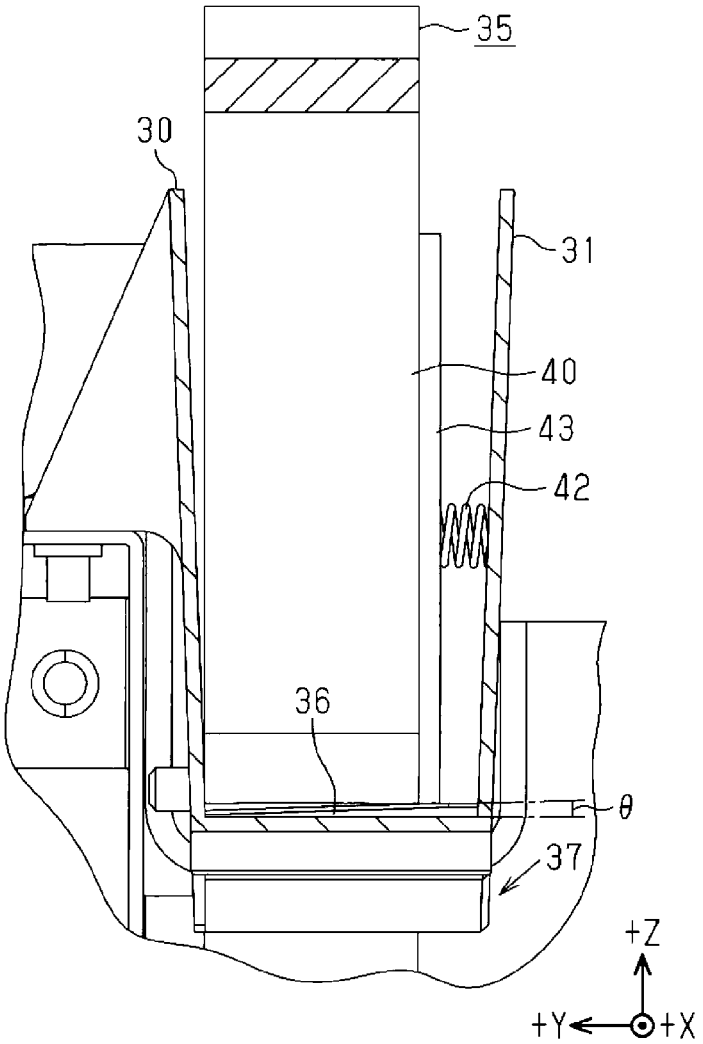
FIG. 16 is a side cross-section of a support section of a Modified Example 8.

As illustrated in FIG. 16, a configuration may be adopted in which a biasing member (for example, a coil spring) 42 is arranged at the inside of the guide member 29, enabling the FFC 35 to be biased by the biasing member 42 toward one side (the +Y direction side in this example) in the Y axis direction through a plate 43. In such a configuration, the biasing force of the biasing member 42 functions alongside the inclination of the support sections 36, enabling the FFC 35 to be strongly biased toward one side (for example, the +Y direction side) in the Y axis direction, and enabling similar advantageous effects to those described at (3) above to be reliably obtained.

In the embodiment described above, instead of providing the rib shaped support sections 36 at plural positions that are spaced apart along the X axis direction, a single, long, rib shaped support section 36 may be provided such that the length direction thereof is a direction that intersects with at least one of the X axis direction or the Y axis direction when viewed along the Z axis direction.

In the embodiment described above, the rib shaped support sections 36 may be provided with slanted profile in which, when viewed along the Z axis direction, the ends on the +Y direction side are skewed toward the +X direction side instead of the −X direction side.

In Modified Example 1 illustrated in FIG. 9, a configuration may be adopted in which the plural projections 51, 52, 53 become sequentially taller in Z axis direction height on progression along the Y axis direction from the projection 53 positioned furthest to the +Y direction side to the projection 51 positioned furthest to the −Y direction side.

In Modified Example 2 illustrated in FIG. 10, all of the support sections 36 may be configured so as to extend in the X axis direction, or all of the support sections 36 may be configured by projection groups formed by rows of plural projections at predetermined spacings. The rows of plural projections are spaced apart along the X axis direction.

In Modified Example 3 illustrated in FIG. 11, as viewed along the Z axis direction, one of the support sections 36 may be provided with a slanted profile such that an end on the +Y direction side is skewed toward the +X direction side, and another of the support sections 36 may be provided with a slanted profile such that an end on the +Y direction side is skewed toward the −X direction side.

In Modified Example 4 illustrated in FIG. 12, the shape of the support sections 36 may, for example, be Y-shaped or S-shaped instead of X-shaped, when viewed along the Z axis direction. In other words, the support sections 36 could be any shape other than what is referred to as an I-shape in which the support sections 36 extend linearly in a direction orthogonal to the X axis direction as in the comparative example illustrated in FIG. 8.

In Modified Example 5 illustrated in FIG. 13, a configuration may be adopted in which the support sections 36 are configured by plural projections arranged in rows instead of by the elongated support sections 36.

In Modified Example 6 illustrated in FIG. 14, the support sections 36 may be configured with shapes that protrude in the +X direction instead of shapes that protrude in the −X direction along the X axis direction.

In Modified Example 7 illustrated in FIG. 15, the inner face of the side wall 30 on the +Y direction side in the guide member 29, and the inner face of the side wall 31 on the −Y direction side, may each be applied with a biasing member such as the biasing member 42 of Modified Example 8 illustrated in FIG. 16.

In Modified Example 8 illustrated in FIG. 16, due to provision of the biasing member 42, a configuration may be adopted in which the support sections 36 on the bottom of the guide member 29 are not inclined.

What is claimed is:

1. A printing apparatus comprising:

a printing head configured to discharge liquid onto a medium so as to print an image on the medium;

a controller configured to control a discharge state of the liquid from the printing head;

a flexible flat cable that electrically connects the printing head and the controller together so as to enable transmission of control signals, and that includes a flat portion; and at least one support section configured to support the flat portion of the flexible flat cable, wherein the flexible flat cable includes a curved portion that is contiguous to the flat portion and is formed by the flexible flat cable being bent back at a given position, when a primary scan direction is defined as a direction in which the printing head moves, and an orthogonal direction is defined as a direction orthogonal to the primary scan direction, in the primary scan direction, the curved portion is configured to move relative to the at least one support section as the printing head moves, in the orthogonal direction, a width of a portion of the at least one support section that is configured to contact the flat portion is shorter than a width of the flexible flat cable.

2. The printing apparatus according to claim 1, wherein:

taking the primary scan direction as an X axis direction, the orthogonal direction as a Y axis direction, and a direction orthogonal to both the X axis direction and the Y axis direction as a Z axis direction, the portion of the at least one support section configured to contact the flat portion is provided such that, when viewed along the Z axis direction, a length direction of the portion is a direction intersecting at least one of the X axis direction or the Y axis direction.

3. The printing apparatus according to claim 2, wherein the portion of the at least one support section configured to contact the flat portion is provided such that, when viewed along the X axis direction, the length direction of the portion is a direction intersecting both the Y axis direction and the Z axis direction.

4. The printing apparatus according to claim 2, wherein:

the portion of the at least one support section configured to contact the flat portion is, when viewed along the Z axis direction, configured by a plurality of projections provided at a plurality of positions that are spaced apart along both the X axis direction and the Y axis direction; and the plurality of projections are configured such that heights in the Z axis direction of neighboring projections in the Y axis direction become sequentially taller.

5. The printing apparatus according to claim 2, wherein, when viewed along the Z axis direction, the at least one support section is provided at a plurality of positions that are spaced apart along the Y axis direction.

6. The printing apparatus according to claim 2, wherein the portion of the at least one support section configured to contact the flat portion, when viewed along the Z axis direction, extends in a direction intersecting the Y axis direction.

7. The printing apparatus according to claim 2, wherein, when viewed along the Z axis direction, the at least one support section is provided at a plurality of positions spaced apart along the X axis direction.

* * * * *